US005330399A

United States Patent [19]

Fan

[11] Patent Number: 5,330,399

[45] Date of Patent: Jul. 19, 1994

[54] BOARD-AND ROPE EXERCISE ASSEMBLY

[76] Inventor: Chen-Yueh Fan, 3rd Fl., No. 2, Alley 2, Lane 88, Sec. 2, Shui Yuan Rd., Hsi Chih Chen, Taipei Hsien, Taiwan

[21] Appl. No.: 108,341

[22] Filed: Aug. 18, 1993

[51] Int. Cl.[5] ..... A63B 4/00

[52] U.S. Cl. ..... 482/34; 482/146; 403/291

[58] Field of Search ..... 482/122, 121, 147, 146, 482/123, 129, 52, 54, 70, 34; 285/239; D21/193

[56] References Cited

U.S. PATENT DOCUMENTS

| | | | |
|---|---|---|---|
| D. 227,584 | 7/1973 | Perez | 482/146 |
| D. 241,863 | 10/1976 | Friedl | D21/193 |
| D. 255,372 | 6/1980 | Tidmore | D21/193 |
| D. 276,062 | 10/1984 | Dennis | D21/193 |
| 2,829,891 | 4/1958 | Ludwig | 482/146 |
| 3,511,500 | 5/1970 | Dunn | 482/146 |
| 3,593,994 | 7/1971 | Anbar | 482/147 |
| 3,613,736 | 10/1972 | Kuwabara | 285/239 |
| 4,200,281 | 4/1980 | Wang | 482/123 |
| 4,909,505 | 3/1990 | Tee | 482/121 |
| 4,976,425 | 12/1990 | Barnes, Jr. | 482/147 |

FOREIGN PATENT DOCUMENTS

| | | | |
|---|---|---|---|
| 0507509 | 10/1992 | European Pat. Off. | 482/123 |
| 0197253 | 4/1908 | Fed. Rep. of Germany | 472/110 |

*Primary Examiner*—Stephen R. Crow
*Assistant Examiner*—Jerome Donnolly
*Attorney, Agent, or Firm*—McCubbrey, Bartels & Ward

[57] ABSTRACT

A board-and-rope exercise assembly includes a curved board made up of an arc-shaped middle portion integrating with two terminal pedals, and two elastic ropes. Each of the ropes is attached to a corresponding one of the pedals. The ropes are pullable in an upper direction, so that an exerciser can exercise his/her limbs by rocking the curved board with his/her legs while pulling the ropes with his/her hands.

6 Claims, 4 Drawing Sheets

BOARD-AND ROPE EXERCISE ASSEMBLY

BACKGROUND OF THE INVENTION

1. Field of Invention

The present invention relates to a board-and-rope exercise assembly.

2. Related Prior Art

In our daily routine work, those who are seated all day long such as office people, students and the like, who seldom exercise their limbs because they are seated or lie down for most of the time. They don't often exercise outdoors, even in the holidays, owing to the heavy traffic or bad weather.

Very often our activities are limited to those indoors which are not able to train bodily balance and to exercise limbs, so, sedentary workers are limited in health.

In general, indoor exercise equipment is not only expensive but also occupies much space, so that it is not available to everyone, especially to those who are seated all day long. What they need is exercise equipment which is easy to carry and of small volume so that a user is able to exercise limbs and to train bodily balance.

The present invention provides exercise equipment occupying a small space and with which people can exercise their limbs and train bodily balance so as to achieve the object of enabling the ordinary office people seated all day long or the students studying hard to exercise limbs and to improve bodily balance.

The prior art being typically large in volume, complex in structure and expensive, can not exercise limbs and train bodily balance, so the present invention focuses on a board-and-rope exercise assembly having lighter weight and smaller volume, to exercise limbs effectively and to train bodily balance.

SUMMARY OF THE INVENTION

It is an object of the present invention to provide a board-and-rope exercise assembly, comprising a curved board made up of an arc-shaped middle portion integrating with two terminal pedals and two elastic ropes.

In operation, the arc-shaped middle portion is disposed on the ground with the pedals disposed above the ground.

The present invention provides two elastic ropes, each of the ropes having two ends firmly attached to a corresponding one of the pedals.

Initially, an exerciser places his/her feet on the pedals, thus, his/her legs can be exercised by rocking the curved board.

Moreover, the exerciser can exercise his/her arms by pulling the ropes. Furthermore, the exerciser can exercise his/her limbs by rocking the curved board with his/her legs while pulling the ropes with his/her hands.

Furthermore, because of the contour of the arc-shaped middle portion, the exerciser must keep his/her body in balance, so as to achieve the object of training his/her bodily balance.

Preferably, the present invention provides a number of bosses on the pedals to prevent the exerciser from sliding off.

DETAILED DESCRIPTION OF THE PREFERRED EMBODIMENTS

Figure 1:
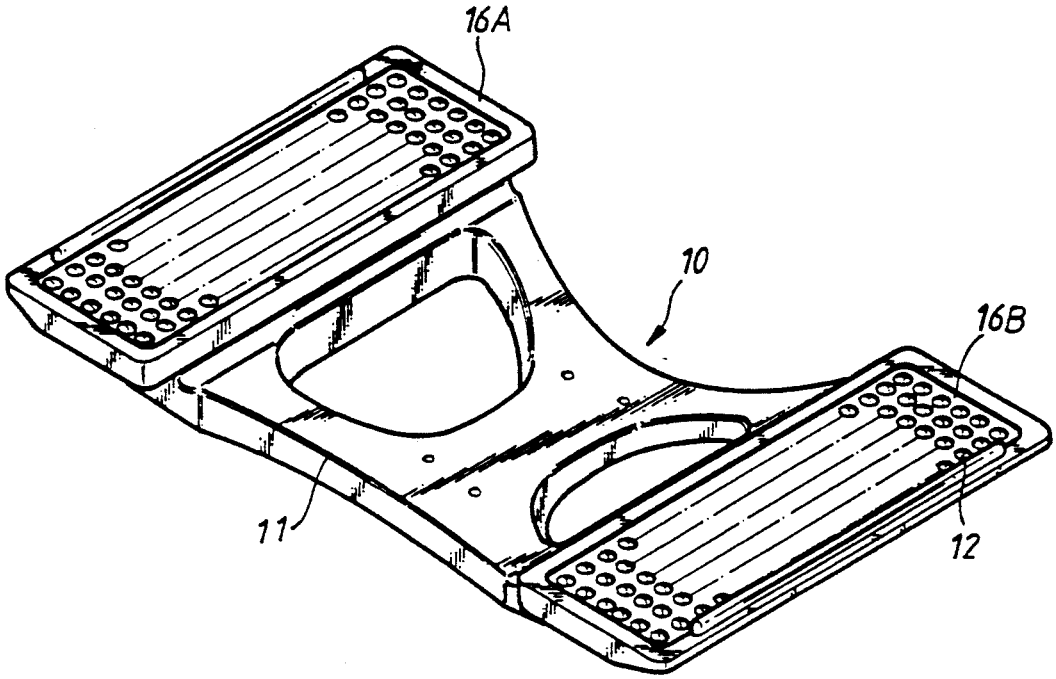
FIG. 1 is a front-right-top perspective view of a curved board in accordance with the present invention, showing an arc-shaped middle portion integrating with two terminal pedals.
Figure 2:
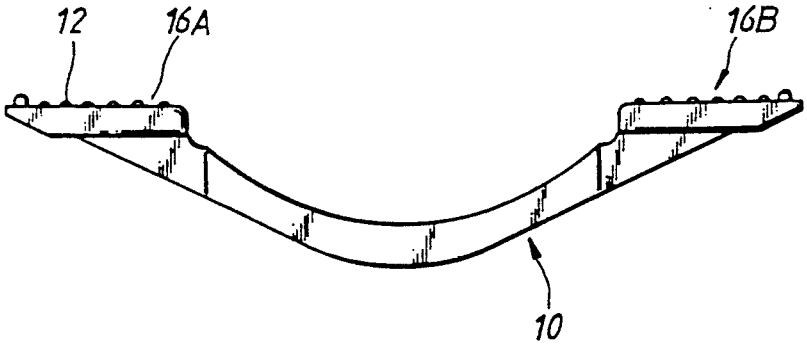
FIG. 2 is a front planar view of the curved board as shown in FIG. 1.
Figures 3, 4:
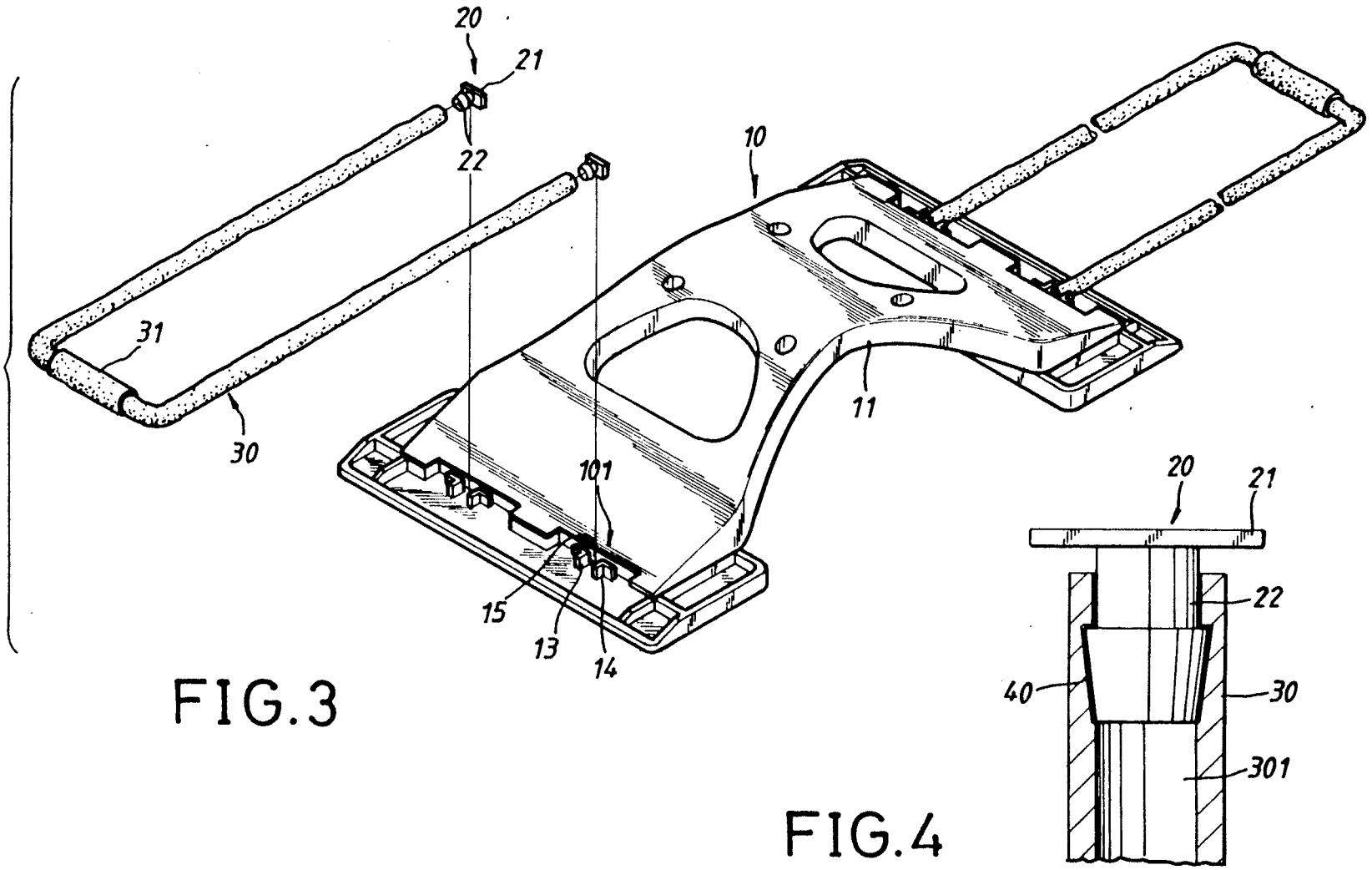
FIG. 3 is a bottom perspective view showing the bottom of an board-and-rope exercise assembly in accordance with the invention.
FIG. 4 is a cross-sectional view of one end of the rope affixed with the locking element in accordance with the present invention.

A board-and-rope exercise assembly has a curved board 10 as shown in FIGS. 1 and 2 and two elastic ropes 30 as shown in FIG. 3.

Referring to FIGS. 1 and 2, a curved board 10 comprises an arc-shaped middle portion 11 integrating with two terminal pedals 16A and 16B. The arc-shaped middle portion 11 is disposed on the ground with the pedals 16A and 16B disposed above the ground.

A number of dome-shaped bosses 12 are provided on the upperside of each of the pedals 16A and 16B to prevent the exerciser from sliding off.

In FIGS. 3 and 4, each of the terminal pedals 16A and 16B has an underside which is undercut to form two recessed areas 101 and each comprising a pair of limits 13 and 14 and a corresponding face thereon. A T-shaped locking section 15 is defined by each pair of the limits 13 and 14 and the corresponding face.

Moreover, the elastic ropes 30 each have two ends which are attached to two locking elements 20 respectively. Each of the locking elements 20 has a flat anchor 21 from which a hook 22 protrudes (see FIG. 4).

The elastic ropes 30 are tubular and the hook 22 of each of the locking elements 20 is adhered in a corresponding one of the ends of each of the ropes 30 by means of glue 40 provided therebetween, so that each of the ropes 30 has two ends firmly attached to the locking elements 20.

Furthermore, each of the anchors 20 is restrained in the locking section 15, so that each pair of the limits 13 and 14 co-operates with a corresponding one of the faces to engage with a corresponding one of the locking elements 20.

Particularly, a tubular handle 31 is provided on the middle portion of each of the ropes 30.

Figure 5:
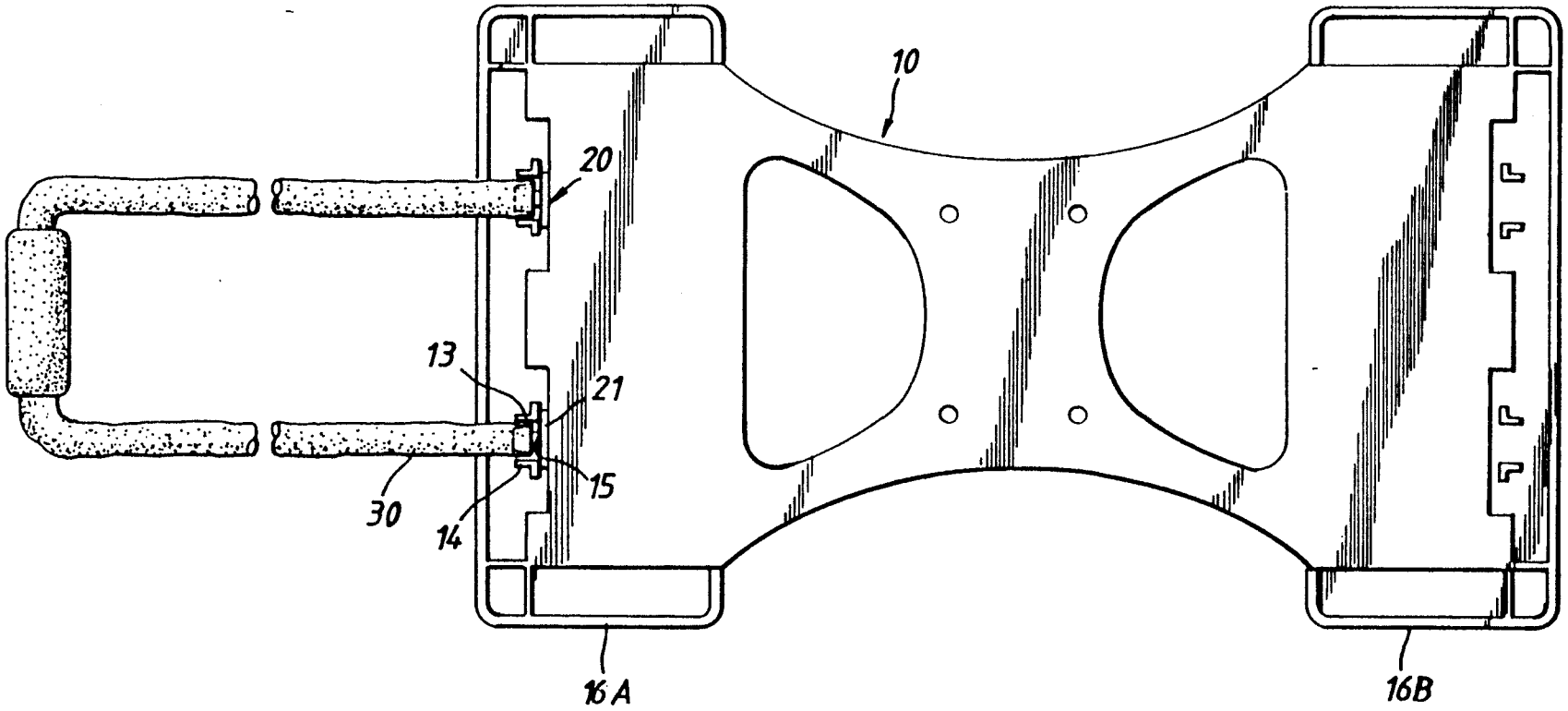
FIG. 5 is a top planar view of the board-and-rope exercise assembly in accordance with the present invention.

It can be clearly seen in FIG. 5 that two ends of each of the ropes 30 are firmly attached to the locking elements 20 which are firmly locked into the locking sections 15.

Particularly, the two opposite sides of the arc-shaped middle portion are recessed.

Moreover, several holes are formed in the arc-shaped middle portion 11 to decrease the weight thereof.

The ropes 30 are pullable in an upper direction so that the exerciser can hold the ropes 30 with his/her two hands.

Figure 6:
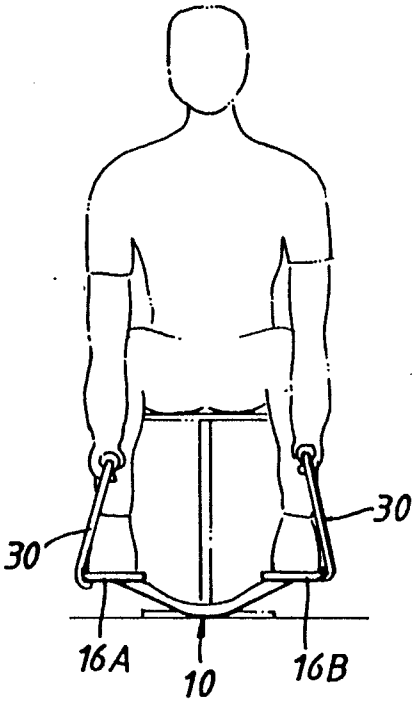
FIG. 6 is a front planar view of the board-and-rope exercise assembly in accordance with the present invention, showing an exerciser, with his/her hands pulling the ropes, sitting down and having his/her feet placed on the pedals.

In FIG. 6, an exerciser, with his/her hands pulling the ropes 30, sits down and has his/her feet placed on the pedals 16A and 16B. Thus the exerciser can exercise his/her limbs by rocking the curved board with his/her legs while pulling the ropes with his/her hands.

Figure 7:
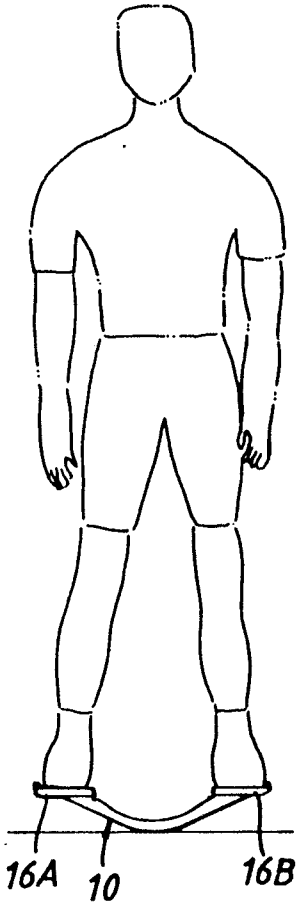
FIG. 7 is a front planar view of the curved board in accordance with the present invention, showing an exerciser standing and having his/her feet placed on the pedals.

In FIG. 7, an exerciser stands and has his/her feet placed on the pedals 16A and 16B, so as to exercise his/her legs by rocking the curved board and to train his/her bodily balance.

Particularly, the board-and-rope exercise assembly in accordance with the invention is easy to carry because of its light weight and small volume.

It should be clear to those skilled in the art that further embodiments of the present invention may be made without departing from the teachings of the present invention.

I claim:

1. A board-and-rope exercise assembly comprising:

a curved board comprising an arc-shaped middle portion integrating with two terminal pedals so that an exerciser can exercise his/her legs by rocking said curved board; and two elastic ropes each attached to a corresponding one of said pedals so that an exerciser can exercise his/her arms by pulling said ropes, each of said elastic ropes comprising two ends, each of said ends being attached to a corresponding locking element comprising a flat anchor member, each of said pedals having an underside and two faces formed thereon by means of undercutting the underside of each of the pedals thereby forming substantially flat surfaces which lie in substantially the same plane as said pedals, each of said faces comprising two pairs of limits, each pair of limits configured so as to form a T-shaped locking section which lies between each pair of said limits and a corresponding one of said faces so as to allow each said elastic rope to extend around an end of a corresponding said pedal.

2. The board-and-rope exercise assembly in accordance with claim 1, wherein:

said elastic ropes are tubular; and each of said locking elements comprises a flat anchor from which a hook protrudes, each of said hooks attached in a corresponding one of said ends of said ropes, each of said anchors restrained by means of a corresponding pair of said limits and a corresponding one of said faces.

3. The board-and-rope exercise assembly in accordance with claim 1, wherein each of said pedals comprises a number of bosses provided on the upperside thereof to prevent the exerciser from sliding off.

4. The board-and-rope exercise assembly in accordance with claim 3, wherein said bosses are dome-shaped.

5. The board-and-rope exercise assembly in accordance with claim 1, further comprising several holes formed in the arc-shaped middle portion to decrease the weight thereof.

6. The board-and-rope exercise assembly in accordance with claim 1, wherein each of said elastic ropes has a middle portion enclosed by means of a tubular handle.

* * * * *